United States Patent [19]

Haskell

[11] Patent Number: 4,737,689

[45] Date of Patent: Apr. 12, 1988

[54] THERMAL DELAY LIGHT ARRANGEMENT

[76] Inventor: Weston W. Haskell, 139 Litchfield, Houston, Tex. 77024

[21] Appl. No.: 75,394

[22] Filed: Jul. 20, 1987

[51] Int. Cl.[4] ..... H05B 37/00

[52] U.S. Cl. ..... 315/323; 315/104; 315/107; 340/82

[58] Field of Search ..... 315/323, 104, 107; 340/82

[56] References Cited

U.S. PATENT DOCUMENTS

| | | | |
|---|---|---|---|
| 3,225,343 | 12/1965 | Kratochvil | 340/82 |
| 3,398,399 | 8/1968 | Brock | 340/82 |
| 3,484,626 | 12/1969 | Grafham | 315/323 |
| 3,541,506 | 11/1970 | Motoyasu et al. | 340/82 |

*Primary Examiner*—Harold Dixon

*Attorney, Agent, or Firm*—Robert W. B. Dickerson

[57] ABSTRACT

The arrangement of this invention includes circuitry for sequentially lighting a series of lamps, followed by extinguishing them in unison; said circuitry including, in association with each lamp, at least one bi-metallic element for controlling the opening or closing of a switch.

5 Claims, 2 Drawing Sheets

THERMAL DELAY LIGHT ARRANGEMENT

BACKGROUND OF THE INVENTION

Light displays have taken many forms, and served many purposes, i.e., educational, productive and entertaining. Not the least of the forms used has been that comprising a string or series of lights intertwined among the limbs of a tree to celebrate a holiday, for example, Christmas Tree lights. Until recently, on an individual string, all lights were on, or all were off, at the same time. More recently, circuits have been developed whereby individual lamps, or groups of lamps, independently, and randomly, light and then become dark. Until now, controlled sequential lighting in a single string, lending itself to, in combination with other strings, more massive displays, has not been possible. Applicant's invention was developed to fill this void, i.e., to provide a circuit for controlling the sequential lighting of a series of lamps, and for extinguishing them all at once. A search has produced the following U.S. Pat. Nos. 2,760,120; 3,793,531; 3,805,049; 4,256,009; and 7,339,598.

SUMMARY OF THE INVENTION

In each embodiment, a plurality of lamps are connected across a pair of conducting wires or leads. A single lamp is activated, i.e., lit, on power being provided to said leads. Flexible bi-metallic means, flexible within a given temperature range, is associated with each lamp, is adapted to control the flow of current to, either the succeeding, sequential lamp or, in the case of the terminal lamp of the sequence, to cause interruption of current to all lamps, and effect recycling. A bi-metallic strip is not new, see for example U.S. Pat. No. 3,015,234. A further embodiment provides regulatable means, including a single adjustable resistance, and additional bi-metallic means associates with each lamp, for varying the time interval between each lamp energization.

DESCRIPTION OF THE INVENTION

Figure 1:
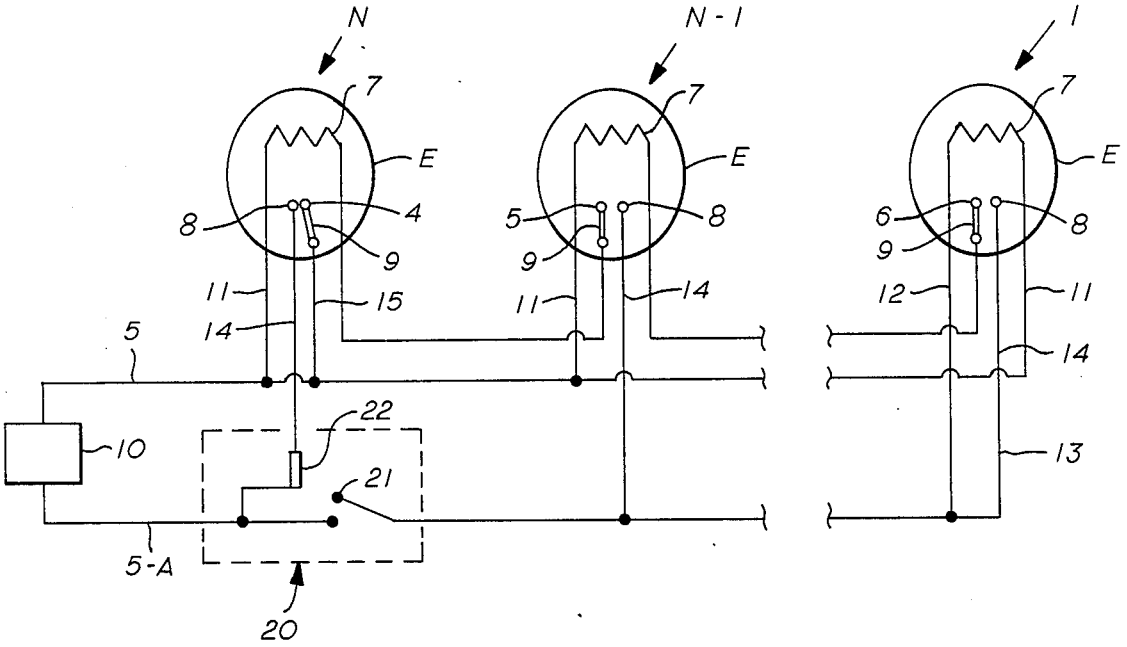
FIG. 1 is a schematic of a first embodiment of the invention.

The basic arrangement of this invention is illustrated in FIG. 1. A source of power 10 may be 110 volt A-C current normally available, although such source is merely illustrative. The voltage from said source is provided to electrical conduits or leads 5 and 5-A.

Any number of lamps 1---N, may be used, limited of course by the current carrying capacity of the mentioned conduits. Each lamp, 1 - - N, is illustrated to be of the four wire variety, rather than have the conventional two wires. Such wires may enter the glass envelope E through a base or socket portion not shown. Each lamp includes the normal glass envelope as well as a filament 7, a fixed electrical contact 8, and a movable electric contact, 4, 5 and 6, respectively. Each movable contact is carried by an arm 9, comprising a bi-metallic strip, a device well known to flex or bend as a function of a temperature range, such range being a function of the metals used in said strip. Thus, each combination of fixed contact 8, on the one hand, and movable arm and contact 9-4, 9-5, and 9-6, on the other, comprise a thermal activated, time delay, switch. It should be noted that the switch of lamps 1---(N-1) are normally open, while the switch of lamp N is normally closed.

One end of each filament 7 is conductively joined to electrical conduit 5 by a lead 11. The other end of filament 7 of lamp 1 electrically communicates with conduit 5-A via lead 12. The other end of the remaining filaments 7 are each electrically joined to movable contact arm 9 of the upstream lamp (upstream herein being seen as moving to the right in FIG. 1). The movable contact of lamp N is joined to line 5 by conductor 15.

Each lamp's fixed contact 8 is joined to wire 5-A by a lead 14. Note that said lead 14 of lamp N communicates with member 5-A via relay 20. Switch 21 of said relay 20 is controlled by current flowing through relay coil 22, such coil forming an integral portion of lead 14 of lamp N. Thus on energizing current flowing through said lead 14, switch 21 is closed. On said current halting, said switch opens.

Consider now the operation of this first embodiment. Prior to source 10 being activated, i.e., before the string is plugged into a wall socket carrying normal house current, 110 volt A.C., no current is flowing through coil 22, leaving switch 21 open. The time delay switches of lamps 1—(N-1) are open, while that of lamp N is closed. On activating power source 10, a voltage is applied across wires 5, 5-A. Due to the closed switch condition of lamp N, energizing current flows in said lamp's lead 14, and through its associated coil 22, closing switch 21 of relay 20. This results in immediate lighting of lamp 1, by virtue of current flow through line 5-A, lead 12, filament 7 of lamp 1, said lamp's lead 11, and wire 5. When filament 7 of lamp 1 heats to a level sufficient to cause said lamp's bi-metallic strip 9 to close its contact 6 with fixed contact 8, current flows through filament 7 of the adjacent, downstream (to the left in FIG. 1), lamp. Reitterating, any number of lamps may be inserted intermediate lamps 1 and N-1, limited by the current-carrying capacity of leads 5, 5-A. The following described events would repetiously occur. After sufficient heating of the filament of the downstream lamp, here being lamp N-1, as to close its movable contact 5 with its fixed contact 8, current would flow through the filament 7 of lamp N. When such filament heats sufficiently, the normally closed relationship between fixed contact 8 and movable contact 4 is altered. Here, the bi-metallic strip carried by movable arm 9, on being sufficiently heated, would open the circuit thereby interrupting current flow through coil 22, opening switch 21, immediately darkening all lamps. This commences the new cycle. As soon as the bi-metallic strip carried by arm 9 of lamp N sufficiently cools, contact is again made between members 4 and 8, energizing coil 22, thereby closing switch 21 and lighting lamp 1.

Figure 2:
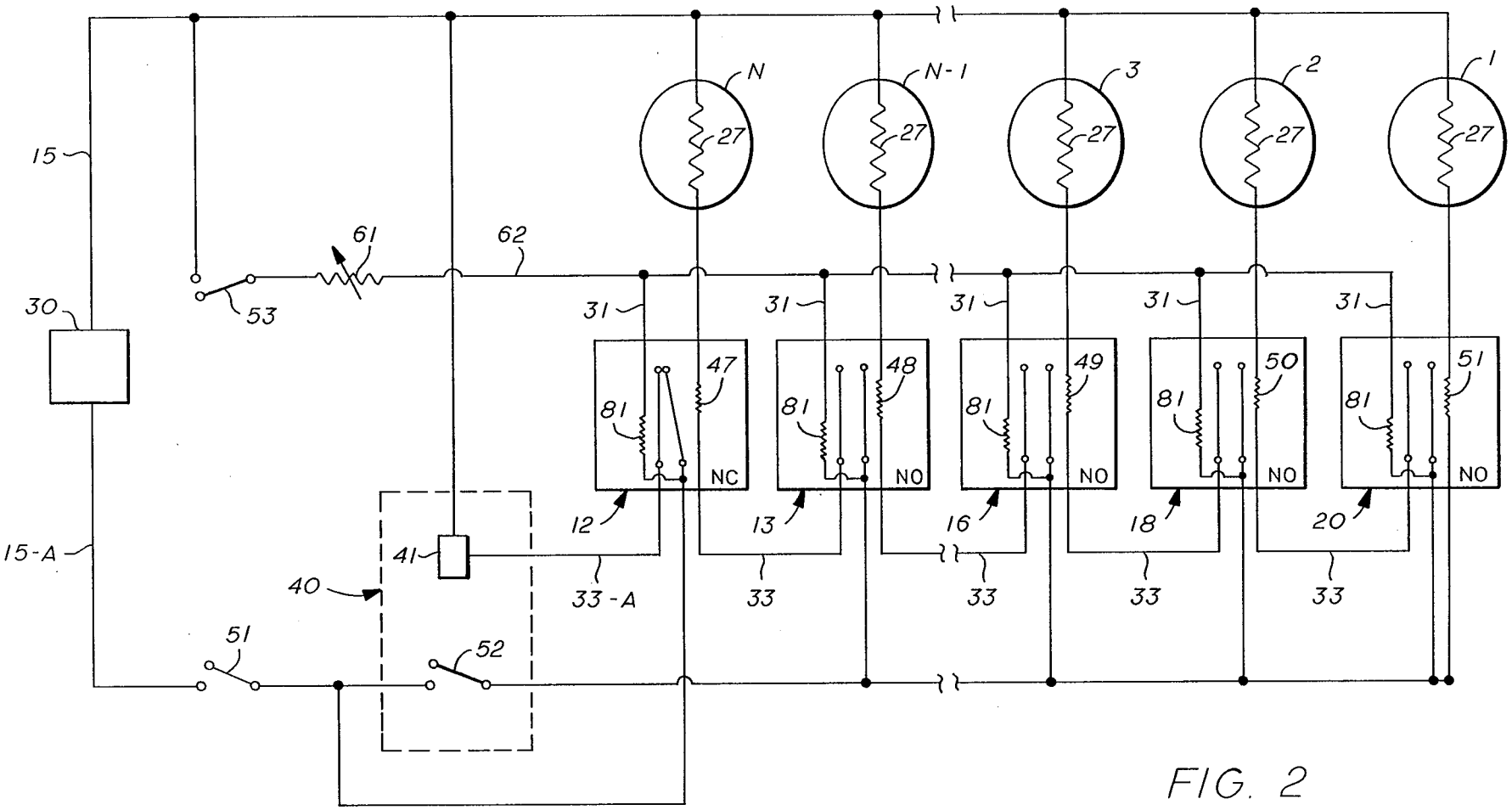
FIG. 2 is a schematic of a second embodiment of the invention.

Consider now the embodiment of FIG. 2. Like the circuit of FIG. 1, a source of power 30, which may be 110 volt A.C., is provided to electrical conduits or leads 15 and 15-A. Again, any number of lamps, 1---N may be provided, limited only by the current carrying capacity of wires 15, 15-A. Each lamp would also include the usual glass envelope, a base or socket portion (not shown), and filament 27. According to the FIG. 2 illustration, the time-delay switch mechanism is positioned outside the envelope. Thus, the common two wire lamp may be used. Obviously, the time-delay circuitry could be positioned in-board, causing the lamps to be of the multi-wire variety. Each lamp is associated with a thermal, time-delay switch 12, 13, 16, 18, 20, respectively. As in the previous embodiment, each such time-delay switch is normally open, save for switch 12, associated with lamp N, which is normally closed.

Manually operable switch S-1 is inserted in line 15-A. Relay 40 includes switch S-2 also inserted in line 15. Current flowing through coil 41 of relay 40, controls the opening and closing of said switch S-2. To this point, the operation of the embodiment of FIG. 2 is like that of the embodiment of FIG. 1. On activating power source 30 and manually closing switch S-1, energizing current through coil 41 of relay 40 will close switch S-2. Immediately, current flows through resistor 51 lighting lamp 1. Heat generated by resistor 51 causes time-delay switch 20 to close, providing current to lamp 2. The same procedure continues to cascade until current is supplied to lamp N, through resistor 47, a component of thermal, time-delay switch 12, which is normally closed. Heating of said resistor 47 causes switch 12 to open, interrupting current flow through coil 41, thereby opening switch S-2, causing all lamps to go dark, ending the cycle. When resistor 47 is sufficiently cool, the next cycle commences.

Figure 3:
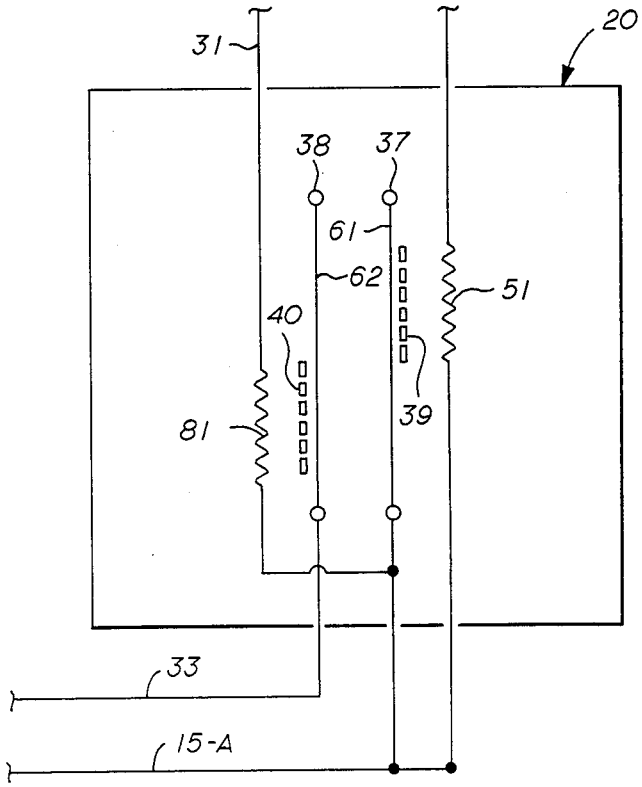
FIG. 3 is a schematic of the normally open thermal switch of FIG. 2.

FIG. 3 illustrates the modification of this second embodiment. A typical, normally open, thermal, time-delay switch, such as switch 20, is illustrated. Current through resistor 51 lights filament 27 of lamp 1, such lamp not illustrated in this Figure. Each switch, such as 20, includes two bi-metallic strip containing lever arms 61 and 62. Such strips are respectively numbered 39 and 40. As strip 39 is heated by current flowing through said resistor 51, such lever arm bends so that its movable contact 37 tends to establish electrical communication with contact 38 on lever arm 62. On this occurring, current flows through lead 33 to light the filament 27 of the next downstream lamp, such as in lamp 2 (see FIG. 2). Manually operated switch S-3 controls current through adjustable resistor 61, from conduit 15, through lead 62, to each of switches 12, 13, 16, 18, 20, through leads 31. Each such lead 31 includes resistance 81. Current through each such resistance 81 causes the bi-metallic strip 40 carried by lever 62 to flex contact 38 away from contact 37 carried by lever arm 61. Obviously as resistance 61 is decreased, current through resistor 81 increases, thereby tending to increase the time necessary for contact 37 to meet contact 38. Thus, this embodiment provides a variable rate sequencing. Obviously in normally closed switch 12, its equivalent to lead 33, namely 33-A controls current flow through coil 41. Current through said switch resistance 81 would vary the time necessary for its normally engaged contacts 38, 37 to disengage, noting that, like the embodiment of FIG. 1, the bi-metallic portions of arms 61, 62, on being heated, tend to move contact 37, 38 in an opposite direction from that of switches 13–20.

Although only limited embodiments have been described, it is obvious that numerous other embodiments would be possible by one skilled in the art without departing from the spirit of the invention, the scope of which is limited only by the following claims.

I claim:

1. A lighting display comprising:

an electrical circuit having a plurality of lamps and means for transmitting current to said lamps;

said circuit further includes combination means, on power being provided to said circuit, for sequentially causing each of said lamps to light, and to thereafter, simultaneously interrupt current flow to all said lamps; said combination means including, associated with each lamp, a thermal activated switching device comprising bi-metallic means for controlling the opening and closing of its respective switching device; and all of said switching devices, save one, is biased toward an open position in the absence of current flowing through the filament of its associated lamp.

2. A lighting display comprising:

an electrical circuit having a plurality of lamps and means for transmitting current to said lamps;

said circuit further includes combination means, on power being provided to said circuit, for sequentially causing each of said lamps to light, and to thereafter, simultaneously interrupt current flow to all said lamps; said combination means including, associated with each lamp, a thermal activated switching device comprising bi-metallic means for controlling the opening and closing of its respective switching device; and each of said switching devices is enclosed within one said lamp.

3. A lighting display comprising:

an electrical circuit having a plurality of lamps and means for transmitting current to said lamps;

said circuit further includes combination means, on power being provided to said circuit, for sequentially causing each of said lamps to light, and to thereafter, simultaneously interrupt current flow to all said lamps; said combination means including, associated with each lamp, a thermal activated switching device comprising bi-metallic means for controlling the opening and closing of its respective switching device; and each said bi-metallic means includes a pair of lever arms, each lever arm including a bi-metallic portion, each lever arm being flexible as a function of current through an adjacent resistance member.

4. The lighting display of claim 3 wherein all of said switching devices, save one, is biased toward an open position in the absence of current flowing through an adjacent resistance member.

5. The lighting device of claim 4, and including adjustable resistance means for varying current flow through one of said adjacent resistance members.

* * * * *